US006612366B1

(12) United States Patent
Chuang

(10) Patent No.: US 6,612,366 B1
(45) Date of Patent: Sep. 2, 2003

(54) PROTECTIVE WRAPPING DEVICE FOR A CONDENSER TUBE

(76) Inventor: Lung-Hsi Chuang, No. 160, Chang-Lu Rd., Hsiu-Shui Hsiang, Chang-Hua Hsien (TW)

( * ) Notice: Subject to any disclaimer, the term of this patent is extended or adjusted under 35 U.S.C. 154(b) by 0 days.

(21) Appl. No.: 10/085,504

(22) Filed: Feb. 26, 2002

(51) Int. Cl.[7] ..... F28F 19/00
(52) U.S. Cl. ..... 165/134.1; 122/DIG. 13
(58) Field of Search ..... 165/134.1; 138/110; 122/DIG. 13

(56) References Cited

U.S. PATENT DOCUMENTS 1,782,829 A * 11/1930 Nash et al. ..... 196/116
2,085,041 A * 6/1937 Reigart et al. ..... 165/134.1
2,629,370 A * 2/1953 Janski ..... 126/201
5,724,923 A * 3/1998 Green ..... 122/511
5,881,802 A * 3/1999 Green ..... 165/134.1
6,065,532 A * 5/2000 Brownlee ..... 165/134.1

FOREIGN PATENT DOCUMENTS

FR 2579739 A * 10/1986 ..... 165/134.1
WO WO 92/08941 A * 5/1992 ..... 165/134.1

* cited by examiner

*Primary Examiner*—Allen Flanigan
(74) *Attorney, Agent, or Firm*—Morgan & Finnegan, LLP

(57) ABSTRACT

A protective wrapping device adapted for shielding a condenser tube of a heat exchanger includes two shell walls configured to complementarily mate with each other and to wrap around the tube for heat removal and for preventing formation of water scale on the tube. A plurality of tightening members are disposed to secure the shell walls to the tube. When the tightening members are released from the shell walls, the shell walls can be detached from the tube for cleaning.

5 Claims, 4 Drawing Sheets

PROTECTIVE WRAPPING DEVICE FOR A CONDENSER TUBE

BACKGROUND OF THE INVENTION

1. Field of the Invention

This invention relates to a protective wrapping device for shielding a condenser tube of a heat exchanger, more particularly to a protective wrapping device adapted for shielding removably the condenser tube of the heat exchanger which is used in an air conditioning system.

2. Description of the Related Art

Referring to FIG. 1, a conventional condenser for an air conditioning system is shown to include a zigzag condenser tube 1 for flow of a refrigerant therethrough, and a cooling tower 3 and a water collecting tank 4 which are disposed above and below the tube 1. Water in the cooling tower 3 falls down for removal of heat of the tube 1 and is collected by the collecting tank 4. Then, the water can be pumped into the cooling tower 3 for circulation.

Since water scales and the like, which are formed on the outer surface of the tube 1, will affect adversely the water cooling operation, it is necessary to clean the tube 1 for removing the same. However, the cleaning operation is inconvenient to conduct because of the zigzag shape of the tube.

SUMMARY OF THE INVENTION

The object of the present invention is to provide a protective wrapping device which can be applied to shield a condenser tube of a heat exchanger and which can be removed therefrom for cleaning, thereby prolonging the service life of the condenser tube.

According to this invention, the protective wrapping device includes complementary first and second shell walls made of a heat conductive material. The first shell wall has a first major wall portion which is elongated in an axial direction, which extends about an axis in the axial direction so as to be adapted to wrap around a first outer wall half of a condenser tube, and which terminates at two axially extending first edge surfaces that are spaced apart from each other in a transverse direction transverse to the axial direction. The first major wall portion has first outer and inner wall surfaces which respectively extend about the axis and which are opposite to each other, and a plurality of first grooves which are formed in the first outer wall surface and which are spaced apart from each other in the axial direction. Each first groove extends about the axis and towards the two first edge surfaces. The second shell wall has a second major wall portion which is elongated in the axial direction, which extends about the axis so as to be adapted to wrap around a second outer wall half of the condenser tube, and which terminates at two axially extending second edge surfaces that are spaced apart from each other in the transverse direction. Each second edge surface is configured to complementarily mate with a respective one of the first edge surfaces so as to define a receiving chamber between the first and second shell walls for receiving fittingly the condenser tube. The second major wall portion has second outer and inner wall surfaces which respectively extend about the axis and which are opposite to each other, and a plurality of second grooves which are formed in the second outer wall surface and which are spaced apart from each other in the axial direction. Each second groove extends about the axis and towards the second edge surfaces, and is registered with a respective one of the first grooves when the first and second shell walls mate with each other so as to bring the first and second grooves in a looped line. Each of a plurality of tightening members is inserted into a registered pair of the first and second grooves along the looped line to tighten the first and second shell walls to each other so as to secure the first and second shell walls to the condenser tube.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
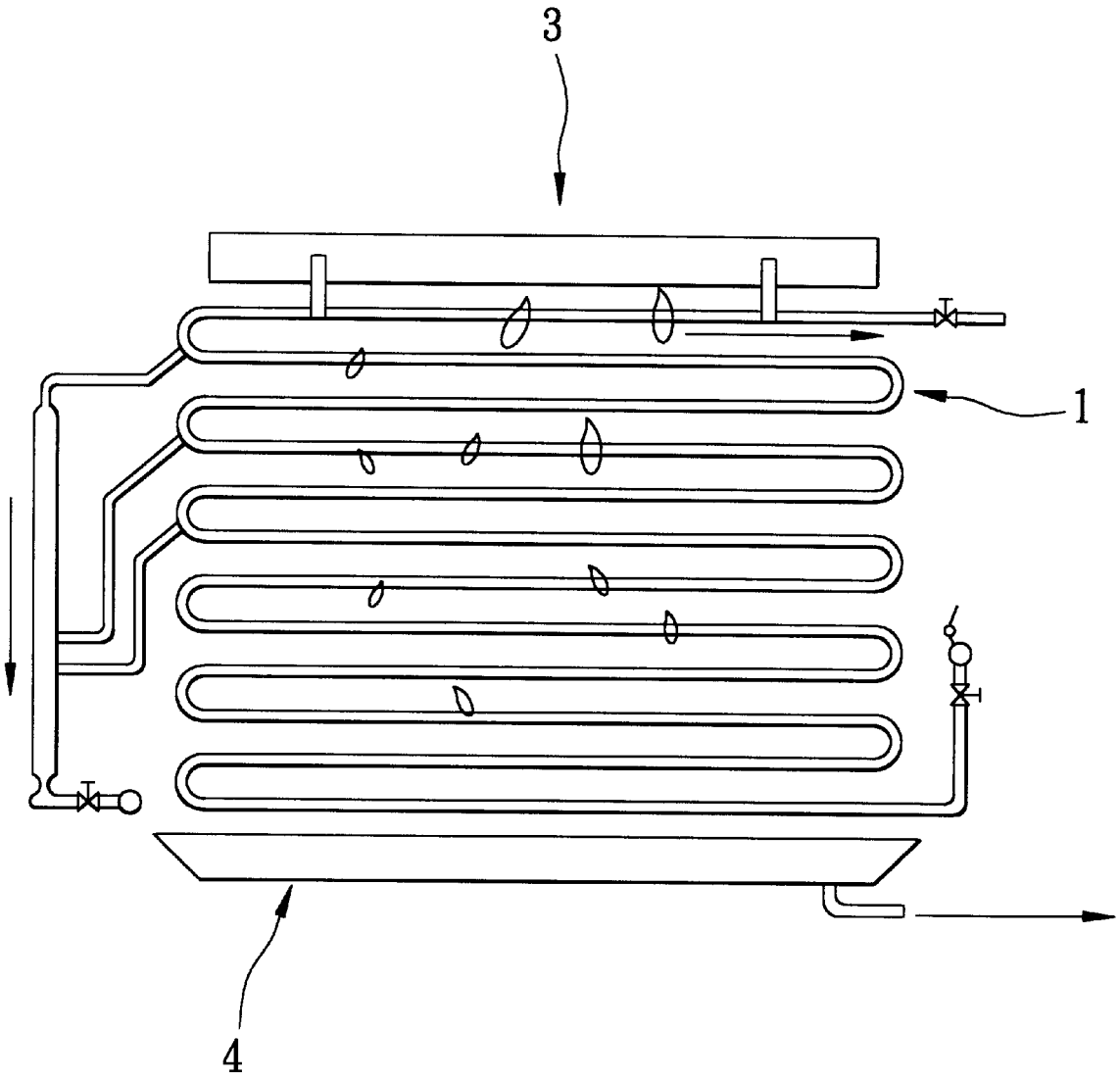
FIG. 1 PRIOR ART
FIG. 1 is a schematic view of a conventional condenser for an air conditioning system.
Figure 2:
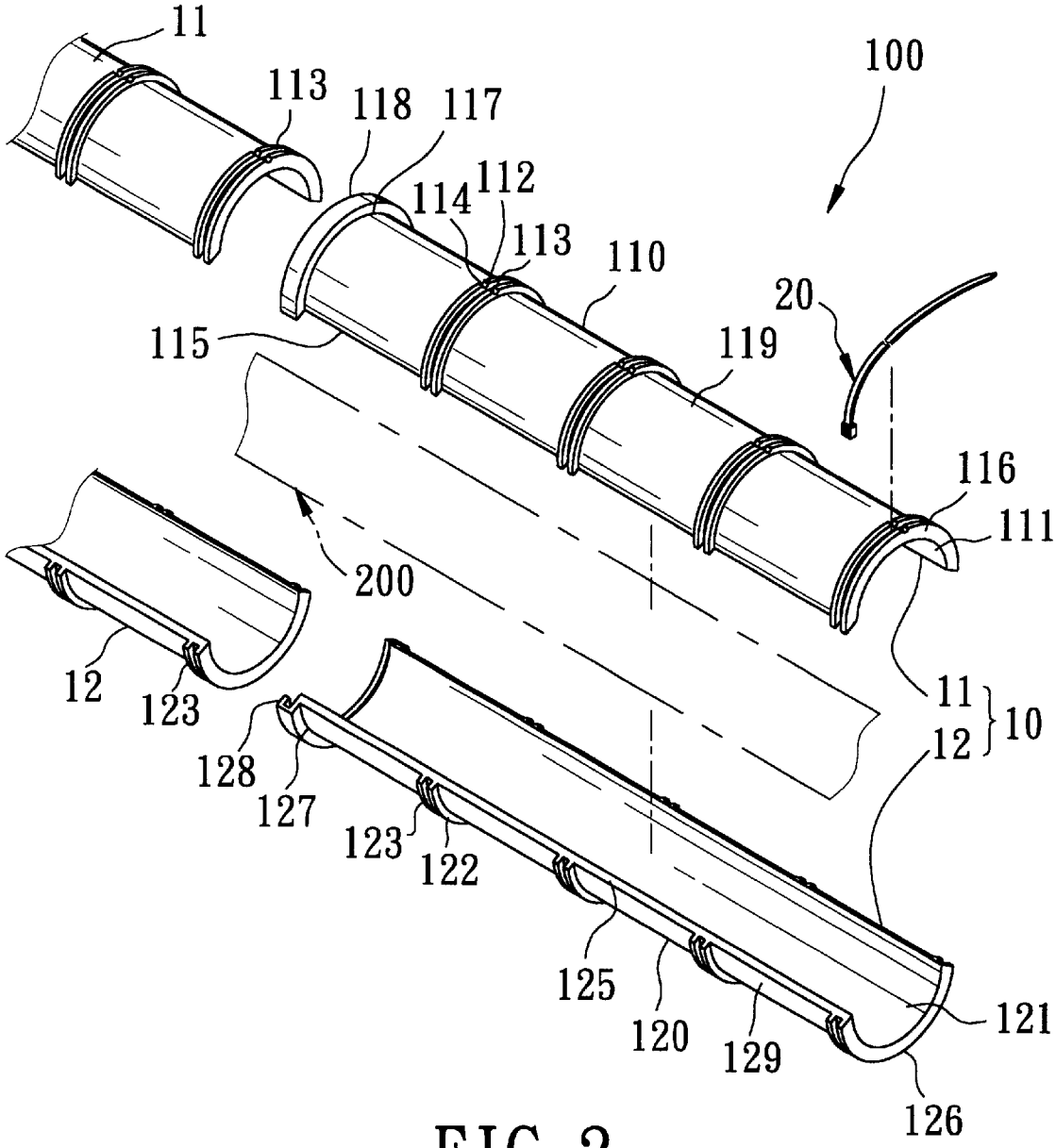
FIG. 2 is an exploded perspective view of a preferred embodiment of a protective wrapping device according to this invention.
Figure 3:
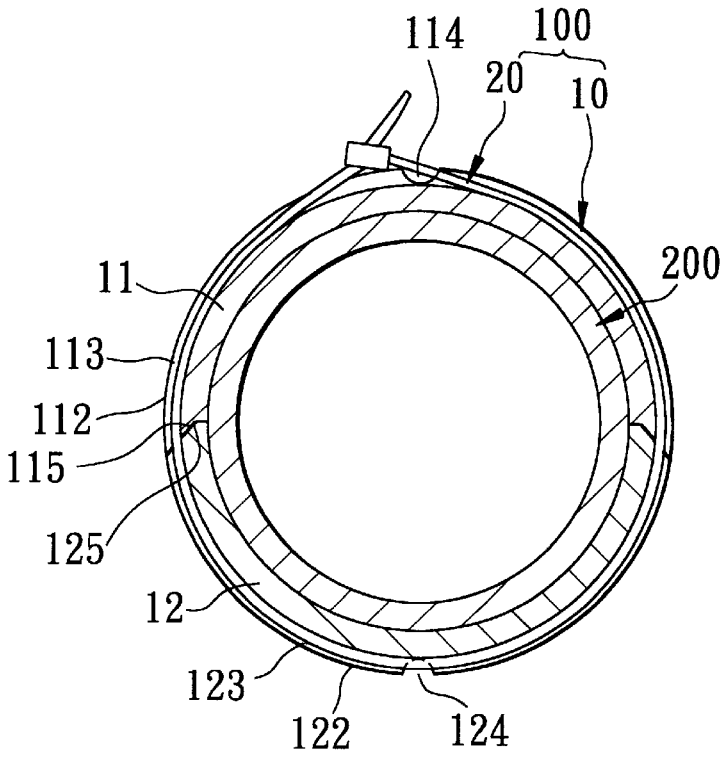
FIG. 3 is a cross-sectional view of the preferred embodiment.

Referring to FIGS. 2 and 3, the preferred embodiment of the protective wrapping device 100 according to the present invention is shown to comprise at least one shielding member 10 and a plurality of tightening members 20. Each shielding member 10 includes complementary first and second shell walls 11,12 which are made of a heat conductive material, such as aluminum.

The first shell wall 11 has a first major wall portion 110 which is elongated in an axial direction, which extends about an axis in the axial direction so as to wrap around a first outer wall half of a condenser tube 200, and which terminates at two axially extending first edge surfaces 115 that are spaced apart from each other in a transverse direction transverse to the axial direction. The first major wall portion 110 has first outer and inner wall surfaces 119,111 which respectively extend about the axis and which are opposite to each other. A plurality of first grooves 113 are formed in the first outer wall surface 119 and are spaced apart from each other in the axial direction. Each first groove 113 is confined by two protrusions 112, and extends about the axis to reach the two first edge surfaces 115. In addition, a plurality of first cutting notches 114 are formed in the first outer wall surface 119 and are disposed transverse to the first grooves 113, respectively.

The second shell wall 12 has a second major wall portion 120 which is elongated in the axial direction, which extends about the axis so as to wrap around a second outer wall half of the condenser tube 200, and which terminates at two axially extending second edge surfaces 125 that are spaced apart from each other in the transverse direction. The second major wall portion 120 has second outer and inner wall surfaces 129,121 which respectively extend about the axis and which are opposite to each other. A plurality of second grooves 123 are formed in the second outer wall surface 129 and are spaced apart from each other in the axial direction. Each second groove 123 is confined by two protrusions 122, and extends about the axis to reach the two second edge surfaces 125. A plurality of second cutting notches 124 are formed in the second outer wall surface 129 and are disposed transverse to the second grooves 123, respectively. Each second edge surface 125 is configured to complementarily mate with the respective first edge surface 115 so as to define a receiving chamber between the first and second shell walls 11,12 for receiving fittingly the condenser tube 200. Further, each second groove 123 is registered with the respective first groove 113 so as to bring the corresponding first and second grooves 113,123 in a looped line.

Each tightening member 20, in this preferred embodiment, is a plastic tightening band, and is inserted into a registered pair of the first and second grooves 113,123 to surround the looped line. Two ends of the tightening band 20 can be tied to each other so as to tighten the first and second shell walls 11,12 to each other, thereby securing the same to the condenser tube 200.

As such, the first and second shell walls 11,12 can be wrapped around the condenser tube 200 for protecting the condenser tube 200 from dust and for heat removal purposes.

Figure 4:
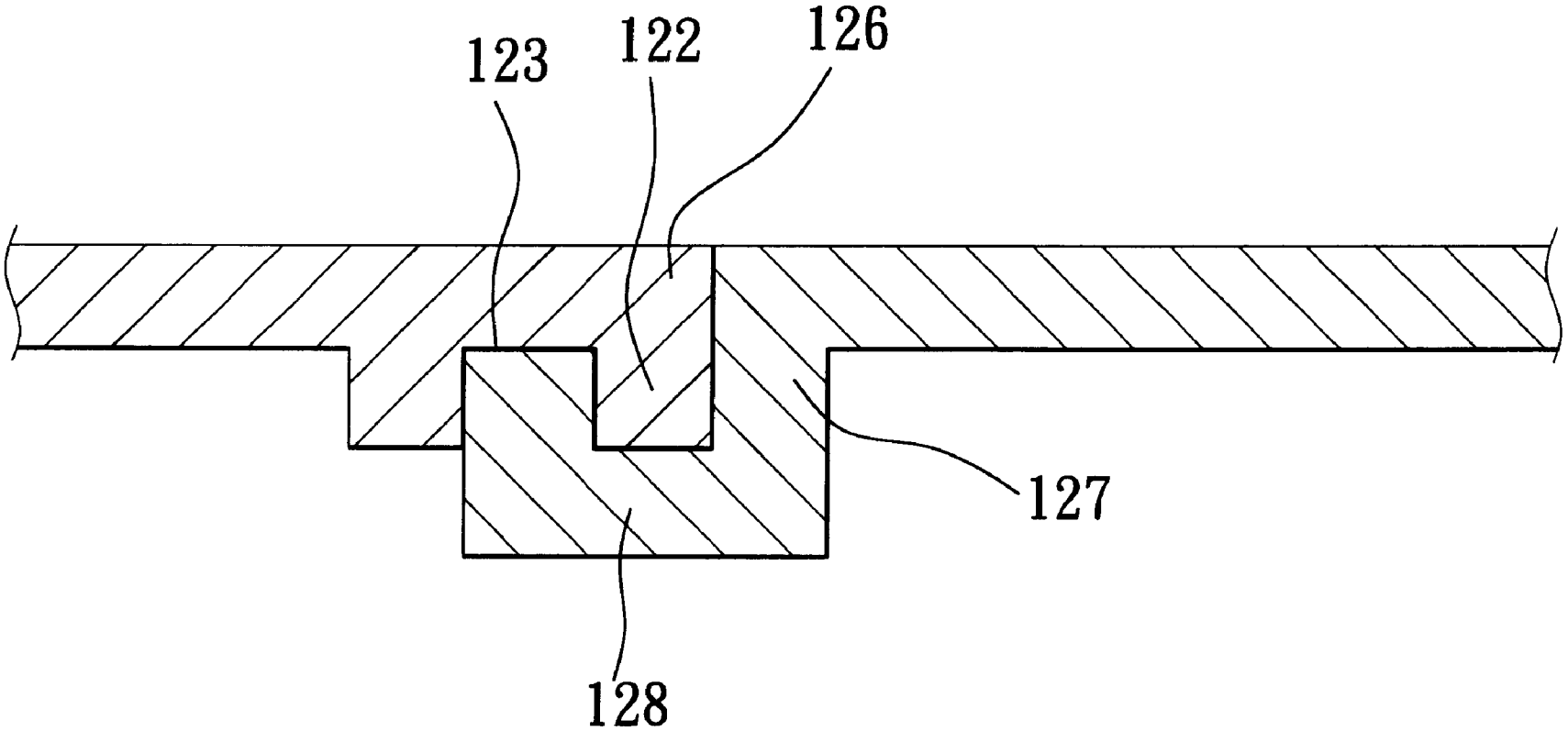
FIG. 4 is a sectional view showing how two adjacent shielding members of the preferred embodiment are interconnected.

Further, each first shell wall 11 has a first right end 116 in which one first groove 113 is formed, and a first left end 117 which is provided with a protrusion 118 that extends about the axis to reach the two first edge surfaces 115. Thus, the protrusion 118 can be inserted into a corresponding first groove 113 in the first right end 116 of an adjacent first shell wall 11. Similarly, as shown in FIG. 4, each second shell wall 12 has a second right end 126 in which one second groove 123 is formed, and a second left end 127 which is provided with a protrusion 128 that extends about the axis to reach the two second edge surfaces 125. Thus, the protrusion 128 can be inserted into a corresponding second groove 123 in the second right end 126 of an adjacent second shell wall 12.

Preferably, the first and second edge surfaces 115,125 are inclined from the first and second inner wall surfaces 111,121 toward the first and second outer wall surfaces 119,129, respectively, such that water condensate, which falls down due to gravity, can be prevented from penetrating between the first and second inner wall surfaces 111,121.

When it is desired to remove the protective wrapping device 100 from the condenser tube 200 for cleaning the former, the tightening bands 20 can be cut by a cutting tool (not shown) extended through the cutting notches 114,124. The first and second shell walls 11,12 can be easily removed and separated from each other. New tightening bands 20 can be used to tighten the first and second shell walls 11,12 once again to each other in order to secure the shell walls 11,12 to the condenser tube 200.

Figure 5:
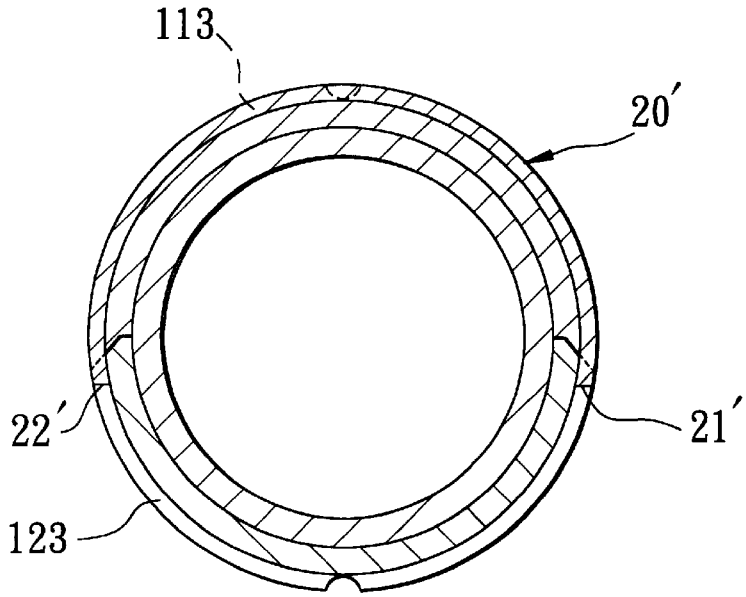
FIG. 5 is a cross-sectional view of another preferred embodiment of this invention.

As shown in FIG. 5, an alternative construction of the tightening member 20' is shown to be in the form of a metal C-shaped ring which includes a jaw portion that is insertable into the respective first groove 113. The jaw portion has two jaw ends 21',22' which are biased toward each other in the transverse direction. Thus, when the jaw portion is inserted into the respective first groove 113, the jaw ends 21',22' extend respectively beyond the first edge surfaces 115 and abut firmly against the second outer wall surface 129 in the respective second groove 123.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A protective wrapping device adapted for shielding a condenser tube which has a passage extending along an axis for flow of a refrigerant therethrough, and first and second outer wall halves respectively extending in an axial direction parallel to the axis and formed integrally with each other to confine the passage, said device comprising:

a first shell wall made of a heat conductive material, and having a first major wall portion which is elongated in the axial direction, which extends about the axis so as to be adapted to wrap around the first outer wall half of the condenser tube, and which terminates at two first edge surfaces that are spaced apart from each other in a transverse direction transverse to the axial direction, each of said first edge surfaces extending in the axial direction, said first major wall portion having first outer and inner wall surfaces respectively extending about the axis and opposite to each other, and a plurality of first grooves formed in said first outer wall surface and spaced apart from each other in the axial direction, each of said first grooves extending about the axis and towards said two first edge surfaces;

a second shell wall made of a heat conductive material, and having a second major wall portion which is elongated in the axial direction, which extends about the axis so as to be adapted to wrap around the second outer wall half of the condenser tube, and which terminates at two second edge surfaces that are spaced apart from each other in the transverse direction, each of said second edge surfaces extending in the axial direction and being configured to complementarily mate with a respective one of said first edge surfaces so as to define a receiving chamber between said first and second shell walls for receiving fittingly the condenser tube, said second major wall portion having second outer and inner wall surfaces respectively extending about the axis and opposite to each other, and a plurality of second grooves formed in said second outer wall surface and spaced apart from each other in the axial direction, each of said second grooves extending about the axis and towards said second edge surfaces, and being registered with a respective one of said first grooves when said first and second shell walls mate with each other so as to bring said first and second grooves in a looped line; and a plurality of tightening members, each inserted into a registered pair of said first and second grooves along the looped line to tighten said first and second shell walls to each other so as to secure said first and second shell walls to the condenser tube.

2. The protective wrapping device of claim 1, wherein each of said tightening members is a plastic tightening band which is inserted into the registered pair of said first and second grooves and which surrounds said first and second outer wall surfaces about the axis to permit two ends thereof to be tied to each other.

3. The protective wrapping device of claim 1, wherein each of said tightening members is a metal C-shaped ring including a jaw portion which is configured to be insertable into the respective one of said first grooves, and which has two jaw ends that are biased toward each other in the transverse direction such that when said jaw portion is inserted into the respective one of said first grooves, said jaw ends extend respectively beyond said first edge surfaces and abut firmly against said second outer wall surface in the respective one of said second grooves.

4. The protective wrapping device of claim 1, wherein said first shell wall has first right and left ends opposite to each other in the axial direction, one of said first grooves being formed in said first right end, said first left end being provided with a protrusion which extends about the axis towards said two first edge surfaces, said second shell wall having second right and left ends opposite to each other in the axial direction, one of said second grooves being formed in said second right end, said second left end being provided with a protrusion which extends about the axis towards said two second edge surfaces, whereby, adjacent ones of said protective wrapping devices can be interconnected by engaging said protrusions on said first and second left ends of said shell walls of one of said protective wrapping devices into said first grooves in said first and second right ends of said shell walls of another of said protective wrapping devices.

5. The protective wrapping device of claim 1, wherein said first and second edge surfaces are inclined from said first and second inner wall surfaces toward said first and second outer wall surfaces respectively such that water condensate, which falls down due to gravity, can be prevented from penetrating between said first and second inner wall surfaces.

* * * * *